US006042306A

United States Patent [19]

Arndts et al.

[11] Patent Number: 6,042,306

[45] Date of Patent: Mar. 28, 2000

[54] CONNECTING LOCK AND SHEET PILE WALL

[75] Inventors: Christian Arndts, Ammersbek; Andreas Wieners, Marl, both of Germany

[73] Assignees: Preussag Stahl, Peine; Fried. Krupp AG Hoesch-Krupp, Essen, both of Germany

[21] Appl. No.: 09/038,077

[22] Filed: Mar. 11, 1998

[30] Foreign Application Priority Data

Mar. 18, 1997 [DE] Germany ..... 197 11 242

[51] Int. Cl.[7] ..... E02D 5/08

[52] U.S. Cl. ..... 405/279; 405/278; 405/285

[58] Field of Search ..... 52/169.7; 405/274–279, 405/285

[56] References Cited

U.S. PATENT DOCUMENTS

| | | | |
|---|---|---|---|
| 831,665 | 9/1906 | Hill | 405/278 |
| 985,150 | 2/1911 | Evennette | 405/277 |
| 1,198,767 | 9/1916 | Reese | 172/371 |
| 1,681,593 | 8/1928 | Pahl | 405/279 |
| 3,688,508 | 9/1972 | Taylor | 405/278 |
| 4,182,087 | 1/1980 | Schall et al. | 405/278 X |
| 4,808,039 | 2/1989 | Fischer | 405/281 |
| 5,292,208 | 3/1994 | Berger | 405/281 |

FOREIGN PATENT DOCUMENTS

| | | |
|---|---|---|
| 18 48 592 | 3/1962 | Germany . |
| 76 30 402 | 9/1978 | Germany . |
| 42 05 455 | 9/1993 | Germany . |

*Primary Examiner*—Eileen Dunn Lillis
*Assistant Examiner*—Tara L. Mayo
*Attorney, Agent, or Firm*—Cohen, Pontani, Lieberman & Pavane

[57] ABSTRACT

A connecting lock and a sheet pile wall, wherein the connecting lock has a straight end and a curved end which are arranged on one side of a center piece, and a hook-shaped end which is arranged on the other side of the center piece. The hook-like end may be arranged directly across from the straight end or the curved end.

3 Claims, 4 Drawing Sheets

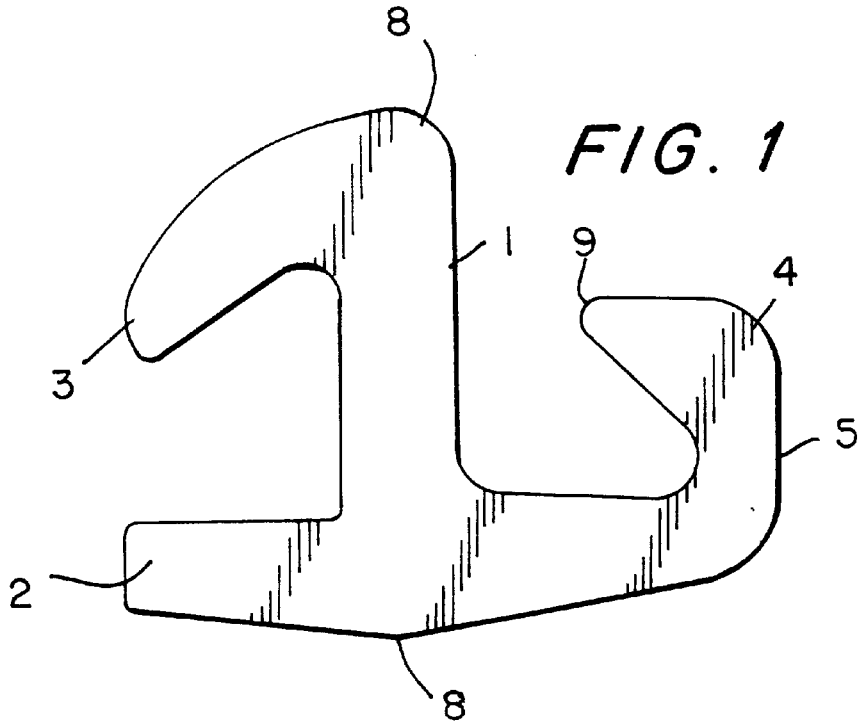
FIG. 1
FIG. 2
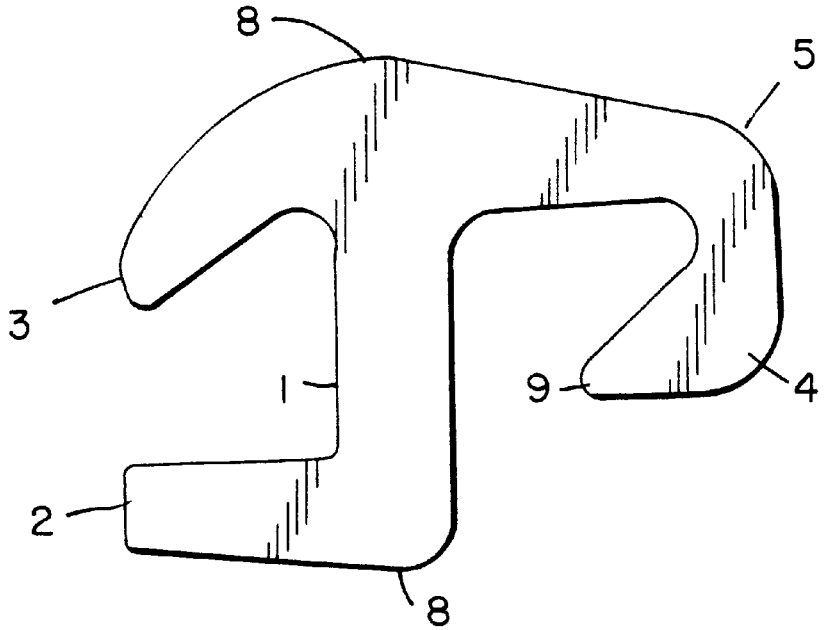

CONNECTING LOCK AND SHEET PILE WALL

BACKGROUND OF THE INVENTION

1. Field of the Invention

The invention relates to a sheet pile wall and in particular to a connecting lock for the connection of sheet pile wall elements.

The invention can be used wherever sheet pile wall elements with hook-shaped ends and sheet pile wall elements with lobe-shaped ends are to be connected to each other.

2. Description of the Related Art

Steel sheet pile wall elements are known, and are used to construct bank reinforcements in harbors and locks as well as for road and tunnel construction. To connect the individual sheet pile wall elements to each other, the ends of these elements are embodied in either a hook-shaped or a lobe-shaped manner. In many cases, a connecting lock is used to connect different sheet pile wall elements.

German reference DE 42 05 455 C1 discloses a double-walled sealing wall of sheet pile wall profiles that serves to seal dumps using the pile-driving method. To connect the sheet pile wall elements, which are reinforced at their ends with a lobe-shaped cross-section, steel locks with curved ends and a center piece are used. However, only sheet pile wall elements with a lobe-shaped cross-section can be connected to each other using these steel locks.

Further, German reference GM 76 30 402 U2 discloses Z-shaped sheet wall pilings, especially for combined sheet pile wall systems, having lobe-shaped connection profiles that are connected to each other by means of H-shaped locking irons. This solution, too, has the disadvantage that only sheet pile wall elements with lobe-shaped ends can be connected to each other by means of the steel locks.

U.S. Pat. No. 1,681,593 discloses steel sheet wall pilings that are connected on both sides at cropped, wedge-shaped reinforcements to an angled steel lock, or on one side to an angled steel lock and on the other side to a claw located in the middle of the center piece. This solution also has the disadvantage that only sheet pile wall elements of a specific design can be connected to each other.

It is also known in the art, for example from U.S. Pat. No. 1,198,767, to connect sheet pile wall elements with hook-shaped ends to each other with or without intermediate elements.

German reference DE-GM 18 48 592 discloses a steel sheet wall piling in which the locking shape of the sheet wall piling is adapted to the locking shape of the other sheet wall piling to be connected. This solution does allow various sheet wall pilings to be connected to each other. However, it is very expensive to adapt the locks of the sheet pile walls to each other, so that disadvantageously the sheet pile wall elements can only be used in limited fashion. For example, the sheet pile wall elements can no longer be rotated in every direction. This expensive solution also runs counter to the idea of sheet pile wall elements as a simple modular system.

In the prior art, it is disadvantageous that the connecting locks for sheet pile wall elements require that the sheet pile wall elements be of a particular design. As a result, sheet pile walls can only be built from a product series of a single manufacturer. Therefore, the prior art is disadvantageous when the individual elements of a product series, are undesirably sized, having, for example, excessively long or short distances between the carrying piles or insufficient mobility in the case of hook-shaped connections. Furthermore, connecting locks in which connecting elements are arranged on the center piece are of limited stability.

SUMMARY OF THE INVENTION

The object of the present invention is therefore to overcome the disadvantages of the prior art so that sheet pile walls may be constructed from sheet wall elements having different cross-sectional ends.

According to the present invention, a straight end and a curved end are arranged on one side of a center piece, so that lobe-shaped cross-sections, e.g., as in double-T carriers, can be accommodated there. A hook-shaped end is arranged on the other side of the center piece, so that sheet pile wall elements equipped with hook-shaped ends can be grasped.

In the present invention, the hook-shaped end is arranged directly on the straight or curved end and not, as in the prior art, in the middle of the center piece.

In one embodiment of the invention, the hook-shaped end is arranged across from the curved end of the connecting lock.

In another embodiment of the invention, the hook-shaped end is arranged across from the straight end of the connecting lock.

In still a further embodiment of the invention, for variable use of the connecting lock, the hook-shaped end is arranged in such a way that it points upward as well as downward.

The continuous casting process is suitable for manufacturing the connecting lock according to the invention. Of course, it is also conceivable to produce the connecting lock by other methods, e.g., by welding together various individual profiles.

The connecting lock according to the present invention, therefore enables sheet pile wall elements of different shapes, e.g., Z-shaped, U-shaped or double-T-shaped, and of different manufacturers, to be connected to each other. A further advantage of the present invention is that fewer sheet pile elements need to be purchased, transported and installed, and therefore fewer anchoring and connecting structures are required.

The various features of novelty which characterize the invention are pointed out with particularity in the claims annexed to and forming a part of the disclosure. For a better understanding of the invention, its operating advantages, and specific objects attained by its use, reference should be had to the drawings and descriptive matter in which there are illustrated and described preferred embodiments of the invention.

BRIEF DESCRIPTION OF THE DRAWINGS

FIG. 1 is a top view of a first embodiment of the connecting lock of the present invention;

FIG. 2 is a top view of a second embodiment of the connecting lock of the present invention;

DETAILED DESCRIPTION OF THE PREFERRED EMBODIMENTS

Figure 3:
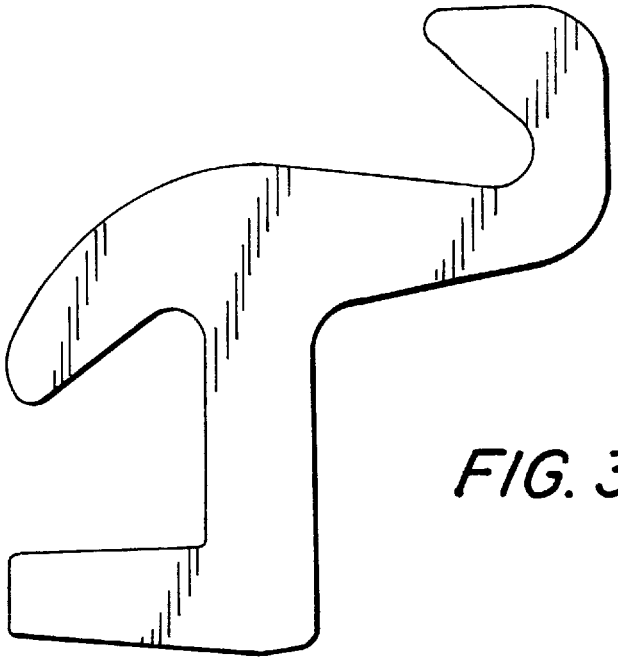
FIG. 3 is a top view of a third embodiment of the connecting lock of the present invention.

FIG. 1 is a view of a first embodiment of a connecting lock 5 of the present invention. The connecting lock 5 comprises a center piece 1 which is generally rectangular in shape, thereby having two narrow sides which are herein defined as shoulders 8. The connecting lock 5 further comprises a curved end 3 and a straight end 2, both being arranged on one broad side of the center piece 1. A hook-shaped end 4, having a tip 9, is arranged on the other broad side of the center piece 1 across from the straight end 2 so as to point upwardly. The tip 9 of the hook-shaped end 4 is therefore disposed between imaginary lines drawn parallel and tangential to the shoulders 8 of the center piece 1. The use of directional terms, such as "upwardly", herein refer to the orientation of the illustrations, and are not intended to limit the actual inventive device.

FIG. 2 illustrates a second embodiment of the connecting lock 5 of the present invention, which is similar to the first embodiment except that the hook-shaped end 4 is arranged on the center piece 1 across from the curved end 3. In this embodiment the hook-shaped end 4 therefore points downward.

A third embodiment of the connecting lock 5 of the present invention is illustrated in FIG. 3, which is similar to the second embodiment in that the hook-shaped end 4 is arranged on the center piece 1 across from the curved end 3. In this embodiment however the hook-shaped end 4 is disposed upwardly so that the tip 9 is external to the imaginary lines drawn parallel and tangential to the shoulders 8 of the center piece 1.

Figure 4:
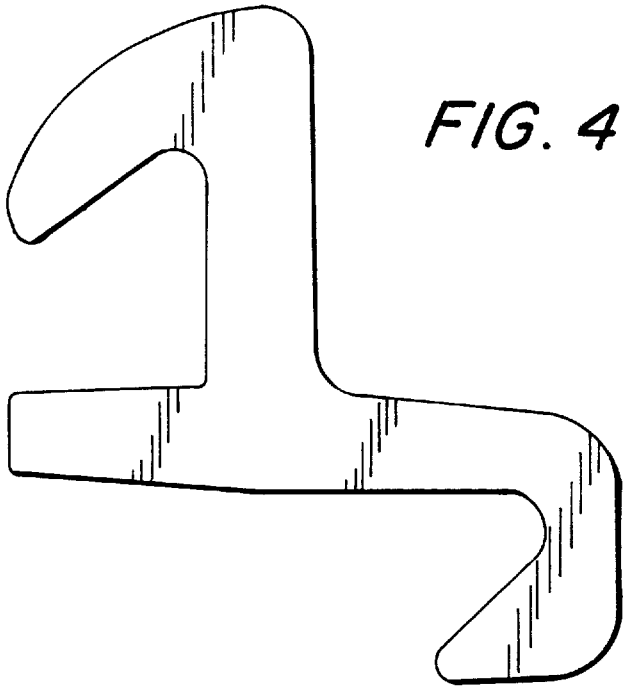
FIG. 4 is a top view of a fourth embodiment of the connecting lock of the present invention.

FIG. 4 illustrates a fourth embodiment of the connecting lock 5 of the present invention, which is similar to the third embodiment except that the hook-shaped end 4 is arranged on the center piece 1 across from the straight end 2. In this embodiment the hook-shaped end 4 is disposed downward so that the tip 9 is external to the imaginary lines drawn parallel and tangential to the shoulders 8 of the center piece 1.

Figure 5:
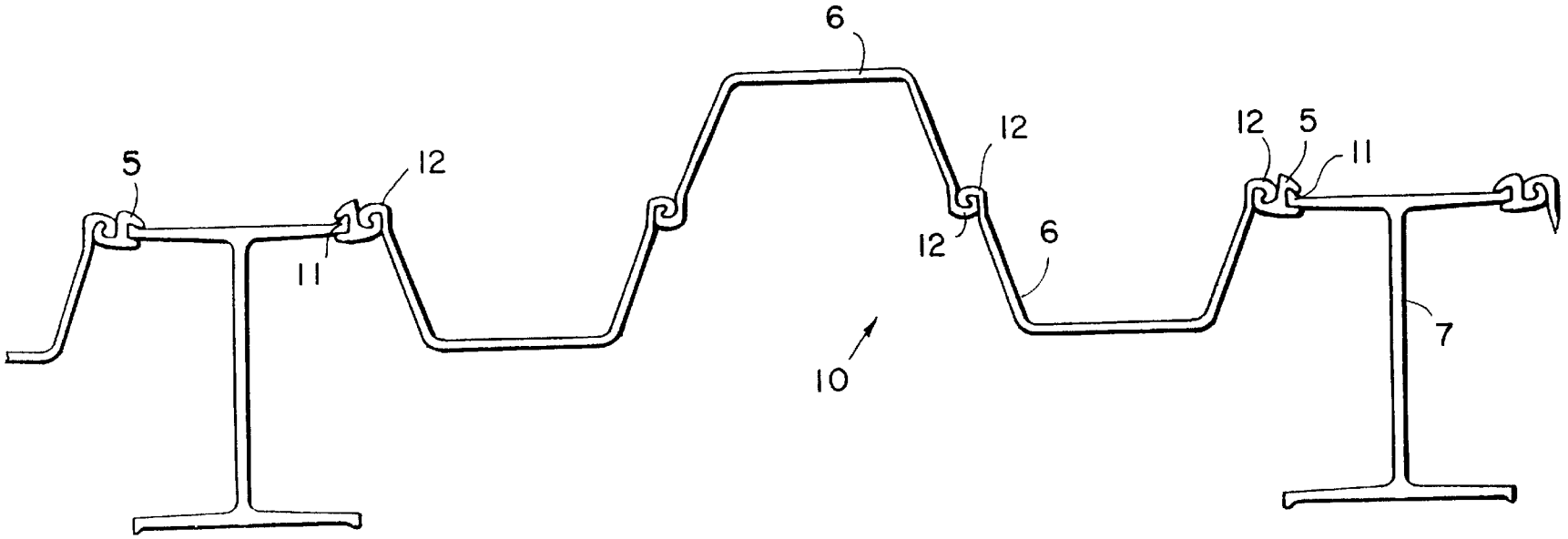
FIG. 5 is a top view of a first embodiment of the sheet pile wall of the present invention.
Figure 6:
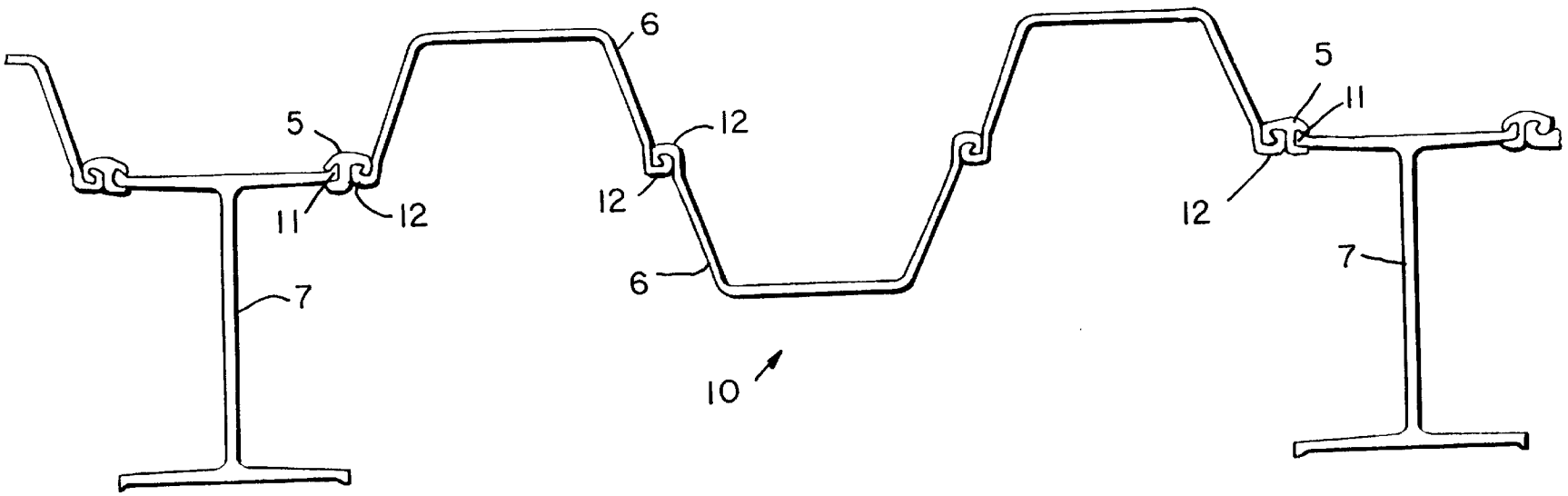
FIG. 6 is a top view of a second embodiment of the sheet pile wall of the present invention.

FIGS. 5 and 6 illustrate the interconnection of sheet pile walls 10 configured as double-T shaped profiles 7 having lobe-shaped reinforcements 11, and sheet pile walls 10 configured as U-shaped profiles 6 having hook-shaped ends 12. The connecting locks 5 connectable fasten the lobe-shaped reinforcements 11 to the hook-shaped ends 12. The particular embodiment of the connecting lock 5 used depends upon the design of the sheet pile wall, as can be seen for example in the difference between the connecting locks 5 of FIGS. 5 and 6. The hook-shaped ends 12 of the sheet pile walls 10 configured as U-shaped profiles 6 may be connected to each other without the use of the connecting lock 5.

The invention is not limited by the embodiments described above which are presented as examples only but can be modified in various ways within the scope of protection defined by the appended patent claims.

We claim:

1. A sheet pile wall, comprising:

sheet pile wall elements having lobe-like ends;

sheet pile wall elements having hook like ends; and connecting locks including, a center piece having two oppositely directed sides, a straight end and a curved end arranged on one of the sides, and a hook-shaped end having a tip, the hook-shaped end being arranged on another of the sides, the connecting locks being arranged to connect the sheet pile wall elements with hook-like ends to the sheet pile wall elements with lobe-like ends.

2. The sheet pile wall in accordance with claim 1, wherein the sheet pile wall elements are Z-shaped.

3. The sheet pile wall in accordance with claim 1, wherein the sheet pile wall elements are U-shaped.

* * * * *